US006350723B1

(12) United States Patent
Mishra et al.

(10) Patent No.: US 6,350,723 B1
(45) Date of Patent: Feb. 26, 2002

(54) BLOCK COPOLYMERS PREPARED BY ANIONIC POLYMERIZATION

(75) Inventors: Munmaya K. Mishra, Richmond, VA (US); Roderic P. Quirk, Akron, OH (US); Robert S. Porzio, Mannheim (DE)

(73) Assignee: Ethyl Corporation, Richmond, VA (US)

( * ) Notice: Subject to any disclaimer, the term of this patent is extended or adjusted under 35 U.S.C. 154(b) by 0 days.

(21) Appl. No.: 09/450,247

(22) Filed: Nov. 29, 1999

Related U.S. Application Data

(60) Provisional application No. 60/110,147, filed on Nov. 30, 1998.

(51) Int. Cl.[7] ..... C10M 145/14

(52) U.S. Cl. ..... 508/472; 526/173; 526/328.5; 526/329.7; 526/348.6; 525/271; 525/299

(58) Field of Search ..... 508/472; 526/173, 526/328.5, 329.7, 348.6; 525/271, 299

(56) References Cited

U.S. PATENT DOCUMENTS

| | | | | | |
|---|---|---|---|---|---|
| 3,856,685 | A | * | 12/1974 | Mori et al. | 508/472 |
| 4,533,482 | A | | 8/1985 | Bollinger | 252/56 |
| 5,002,676 | A | | 3/1991 | Willis et al. | 252/56 |
| 5,026,496 | A | * | 6/1991 | Takigawa et al. | 508/472 |
| 5,429,758 | A | * | 7/1995 | Hayashi et al. | 508/472 |
| 5,563,118 | A | * | 10/1996 | Mishra et al. | 508/472 |
| 5,629,393 | A | | 5/1997 | Varshney et al. | 526/175 |
| 5,677,387 | A | | 10/1997 | Bayard et al. | 525/299 |
| 5,763,374 | A | * | 6/1998 | Sakai et al. | 508/472 |
| 5,834,831 | A | * | 11/1998 | Mishra et al. | 508/472 |
| 5,891,831 | A | * | 4/1999 | Matsuya et al. | 508/472 |
| 6,013,735 | A | * | 1/2000 | Mishra et al. | 525/299 |

FOREIGN PATENT DOCUMENTS

| | | |
|---|---|---|
| EP | 0 298 667 | 1/1989 |
| EP | 0 408 420 | 1/1991 |

* cited by examiner

*Primary Examiner*—Jacqueline V. Howard
(74) *Attorney, Agent, or Firm*—Dennis H. Rainear

(57) ABSTRACT

Block copolymers having a molecular weight distribution of between 1.0 and 5.0 comprising at least one block of polymerized alkyl methacrylate monomer(s), wherein from 50 to 100% by weight of the monomers for forming the alkyl methacrylate block are C12–C30 alkyl methacrylates, and a block of a polymerized conjugated alkadiene. The block copolymers of the present invention are useful as viscosity index improvers in lubricating oil compositions as well as compatibilizers for compositions containing both polymethacrylates and olefin copolymers or hydrogenated block polymers.

48 Claims, No Drawings

BLOCK COPOLYMERS PREPARED BY ANIONIC POLYMERIZATION

This application claims the benefit of U.S. Provisional Patent application Ser. No. 60/110,147, filed Nov. 30, 1998.

TECHNICAL FIELD

The present invention is directed to novel block copolymers and a process for the anionic polymerization of block copolymers comprising a block of at least one polymerized diene and at least one block of at least one polymerized long-chain alkyl methacrylate. The invention also relates to the use of said block copolymers in lubricating oil compositions.

BACKGROUND OF THE INVENTION

The use of polyalkyl methacrylates as viscosity index improvers and pour point depressants for lubricating oils is well known. Further, it is known to use olefin copolymers or hydrogenated block copolymers as viscosity index improvers and dispersants for lubricating oil compositions. It would be advantageous to provide to a lubricating oil a polylalkyl methacrylate polymer and also an olefin copolymer or a hydrogenated block polymer in order to obtain the advantages associated with both types of additive in a lubricating oil composition.

In practice, however, the use of both types of additive is not always feasible. At high concentrations of additive in the oil, physical mixtures of polyalkyl methacrylates and olefin copolymers or hydrogenated block polymers are immiscible and separate into two distinct phases. This is highly undesirable in lubricating oil formulations. Attempts have been made to chemically combine the polyalkyl methacrylate function and a polyalkadiene function in a single polymeric molecule and thereby avoid such compatibility problems. U.S. Pat. No. 4,533,482, describes random copolymers of alkyl acrylate or methacrylate and a conjugated diene wherein the aliphatic unsaturation has been hydrogenated. Such polymers are relatively high molecular weight materials having a molecular weight from about 80,000 to about 1,000,000.

European Patent Application No. 298,667, describes block copolymers in which one block is selected from hydrolyzable C2–C5 alkyl methacrylates, methacrylic acid or ionomers thereof, and at least one other block is a block of an anionically polymerized monomer other than methyl methacrylate. Illustrative of such monomers is butadiene and isoprene. The Application does not suggest the block polymers of the present invention or their use in lubricating oil compositions.

U.S. Pat. No. 5,002,676 teaches selectively hydrogenated block copolymers comprising at least one block of polymerized alkyl methacrylate and one block of at least one polymerized conjugated alkadiene and the use of said copolymers in lubricating oil compositions. The reference fails to teach the specific copolymers or the processes of the present invention.

SUMMARY OF THE INVENTION

The present invention is directed to block copolymers, processes for preparing said block copolymers and to lubricating oil compositions containing said copolymers. More particularly the present invention relates to block copolymers comprising at least one block of polymerized alkyl methacrylate monomer(s), wherein at least 50% by weight of the alkyl methacrylate monomers are C12–C30 alkyl methacrylates, and a block of a polymerized conjugated alkadiene. The block copolymers of the present invention are useful as viscosity index improvers in lubricating oil compositions as well as compatibilizers for compositions containing both polymethacrylates and olefin copolymers or hydrogenated block polymers.

The processes of the present invention allow one to predictably and reproducibly control the molecular weight, molecular weight distribution, copolymer composition and diene microstructure of the long-chain alkyl methacrylate/diene block copolymers.

DETAILED DESCRIPTION OF THE INVENTION

The block copolymers of the present invention are block copolymers having at least one block of polymerized long-chain alkyl methacrylate momomer(s) and a block derived from conjugated alkadiene monomer(s).

The nonhydrogenated block copolymers are termed A-B or A-B-A copolymers wherein A represents a block of polymerized long-chain alkyl methacrylate monomer(s) and B represents a block of conjugated alkadiene monomer(s).

A variety of conjugated alkadienes of up to 10 carbon atoms are useful as the precursor of the B block, e.g., 1,3-hexadiene, piperylene, 1,3-octadiene and 3-methyl-1,3 pentadiene. The preferred conjugated alkadienes for use in the block copolymers are butadiene and isoprene, most preferably isoprene. Preferably 50 to 100%, more preferably 90 to 100% of the monomers used in forming block B are conjugated dienes.

The alkyl methacrylate block(s), block A, is obtained by the polymerization of alkyl methacrylate monomer(s) wherein 50% to 100%, preferably 80 to 100%, by weight of the monomer(s) used for forming block A are C12–C30 alkyl methacrylates.

As used herein, C12–C30 alkyl methacrylate means an alkyl ester of methacrylic acid having a straight or branched alkyl group of 12 to 30 carbon atoms per group such as lauryl methacrylate, myristyl methacrylate, stearyl methacrylate, cetyl methacrylate, heptadecyl methacrylate, nonadecyl methacrylate, eicosyl methacrylate, and mixtures thereof such as cetyl-eicosyl methacrylate and cetyl-stearyl methacrylate. The preferred alkyl methacrylate is lauryl methacrylate. The polymerized alkyl methacrylate blocks may contain minor amounts, i.e., less than 50%, preferably less than 30% and more preferably less than 5%, by weight, of C1–C11 alkyl methacrylates.

Additional monomers may be used in forming the block copolymers of the present invention. These monomers include styrene, alpha-methylstyrene, vinyl toluene, t-butyl styrene, chlorostyrene, 1,1-diphenylethylene, vinyl naphthalene, 2-vinylpyridine, 4-vinylpyridine, N-vinylimidazole, N-vinylpyrrolidone, alkyl (meth) acrylates containing dispersant moieties and alkyl (meth) acrylamides containing dispersant moieties. Suitable (meth) acrylate and (meth) acrylamide dispersant monomers include N,N-dimethylamino propyl methacrylamide, N,N-diethylamino propyl methacrylamide, N,N-dimethylaminoethyl acrylamide, N,N-diethylaminoethyl acrylamide, N,N-dimethylaminoethyl methacrylate, N,N-diethylaminoethyl acrylate, N,N-diethylaminoethyl methacrylate, N,N-dimethylaminoethyl thiomethacrylate, poly(ethylene glycol) ethyl ether methacrylate, poly (ethylene glycol) 4-nonylphenyl ether acrylate and poly (ethylene glycol) phenyl ether acrylate. These additional monomers may be incorporated into either block as long as they do not interfere with the polymerization of that block, i.e., the desired molecular weight and molecular weight distribution of the resulting block and block copolymer is still obtained. Typically, the non-polar monomers, if used, will be incorporated into the alkadiene block, while the polar monomer, if used, will be added during the polymerization of the alkyl methacrylate block. In a preferred embodiment of the present invention, these additional monomers will be present in an amount of 0 to 25, preferably 0 to 10, wt. % based on the total weight of monomers used in forming the block in which these additional monomers are to be added.

In one particularly preferred embodiment of the present invention, 95 to 100 wt. % of the monomer used for forming the polyalkadienyl block is isoprene and 95 to 100 wt. % of the monomer used for forming the alkyl methacrylate block is lauryl methacrylate.

The block polymers of the present invention are preferably made in accordance with the teachings of the Ph.D. Dissertation, Porzio, R. S., *Anionic Synthesis of Block, Functionalized and Star-Branched Poly (Alkyl Methacrylates)*, University of Akron, December 1997, incorporated herein by reference.

The alkyl methacrylate monomer(s) must be purified. Purification of the alkyl methacrylate monomer(s) may be conducted by those methods commonly used in the art such as distillation from trialkylaluminum or standard fractional distillation. Due to the high amount of long-chain alkyl methacrylate monomers, i.e., 50–100 wt. % C12–C30 alkyl methacrylates, used in forming the polymethacrylate block (s) of the copolymers of the present invention, standard fractional distillation is a preferred method of purifying the methacrylate monomers. Standard fractional distillation comprises passing the alkyl methacrylate through activated alumina and filtering, if necessary, to remove any alumina particulate. The monomer is then vacuum distilled and the desired fraction, e.g. in the case of lauryl methacrylate the middle fraction having a boiling point of 78° C. at 0.05 mm Hg, is collected.

Special considerations also apply to the order in which the blocks are produced. Polymerization of the base block copolymers of the invention which may subsequently selectively hydrogenated must necessarily involve the initial production of a polymerized conjugated alkadiene portion followed by production of the alkyl methacrylate block(s).

The alkadiene block is obtained by the polymerization of at least one alkadiene. Although mixtures of alkadienes, e.g. butadiene and isoprene, may be used to obtain a block with a random mixture of monomeric alkadienes, the use of a single alkadiene is preferred. More preferably, the alkadiene is isoprene.

The initiator suitable for the alkadiene polymerization is a metal alkyl initiator of the formula:

R-M in which M is an alkali metal or an alkaline earth metal and R is a straight-chain or branched alkyl or cyclo-alkyl preferably having from 1 to 6 carbon atoms, an aryl or an alkylaryl. Examples of such initiators include, for example, hydrocarbyl lithium initiators such as alkyllithium compounds, preferably methyl lithium, n-butyllithium, sec-butyllithium, cycloalkyllithium compounds, preferably, cyclohexyllithium and aryllithium compounds, preferably, phenyllithium, 1-methylstyryllithium, p-tolyllithium, naphthyllithium and 1,1-diphenyl-3-methylpentyllithium. Also useful initiators include, naphthalene sodium, 1,4-disodio-1,1,4,4-tetraphenylbutane, diphenylmethyl potassium, and diphenylmethyl sodium. Tertiary alcoholates of lithium and compounds containing trimethylsilyl groups may also be employed. Particularly preferred in the block polymerization process of the invention is sec-butyl lithium.

The polymerization of the alkadiene monomer preferably takes place at a temperature of from about 20° C. to about 70° C. Polymerization takes place in a liquid non-polar hydrocarbon solvent such as cyclohexane, benzene, t-butylbenzene, Decalin™, Tetralin™, toluene or mixtures thereof. The most preferred solvent is t-butylbenzene. The solvents and reaction conditions may be selected so as to obtain a polydiene block having the desired microstructure. For example, when isoprene is the monomer to be polymerized in a non-polar solvent, from about 60% to about 98% of the isoprene monomers are polymerized by way of 1,4 polymerization. Because the Tg of the isoprene polymer decreases as the 1,4-polydiene microstructure increases, it is highly desired, for certain applications, to obtain polyisoprene blocks having a high percentage of 1,4-polydiene microstructure. The presence of the ethylenic unsaturation results in cis and trans configurations of the polymer chain at each carbon-carbon double bond. Polymerization to give a cis configuration is predominate.

In a preferred embodiment of the invention, a living polyalkadiene polymer (i.e., poly (dienyl) lithium) is produced by polymerization of the conjugated alkadiene in the presence of a mono-finctional initiator such as sec-butyl lithium.

In an alternate embodiment of the process of the invention, the conjugated alkadiene is polymerized through the use of a difunctional alkali metal alkyl-initiator. Such difunctional initiators are also conventional and are illustrated by 1,4-dilithio-1,1,4,4-tetraphenylbutane and 1,3 bis (1-lithio-1,3-dimethylpentyl)benzene. The use of such difunctional initiators generally results in the production of a difunctional living polyalkadiene polymer which, upon the subsequent addition of a polymerized alkyl methacrylate block at each reactive site, will result in the production of an ABA polymer.

After formation of the polyalkadiene but prior to addition of long-chain alkyl methacrylate monomer(s) a more polar solvent and a protecting group monomer are added to the reaction vessel. Suitable "polar" solvents include the ethers such as diethyl ether, methyl-t-butyl ether, diglyme, tetraglyme and tetrahydrofuran. The amount of polar solvent is from about 10% by volume to about 50% by volume based on total combined solvent. Prior to polymerization of the alkyl methacrylate block, it is necessary to modify the reactivity of the poly (dienyl) lithium chain-end by end capping with a protecting monomer group. The protecting group monomer is reacted with the poly (dienyl) lithium anion to form a bulky macroinitiator for polymerizing the alkyl methacrylate block. Preferred protecting group monomers include 1,1-diphenylethylene and alpha-methylstyrene.

A lithium salt selected from the group consisting of lithium chloride and lithium alkoxides must also be added to the reaction vessel prior to the addition of the long-chain alkyl methacrylate monomers. The preferred lithium salt is lithium chloride (LiCl). Typically, the lithium salt will be added in an amount of from 1 to 10 molar equivalents of lithium salt to initiator in order to afford a living polymerization and obtain the desired narrow molecular weight distribution. In a preferred embodiment, the lithium salt is added prior to the diene polymerization. Some lithium salt may remain insoluble in the non-polar solvent, however, this will not interfere with the diene polymerization. Upon addition of the polar solvent the remaining lithium salt should dissolve.

The polyalkadienyl polymer is then reacted, typically in situ without the need for additional purification, with the purified long-chain alkyl methacrylate as described above in the mixed solvent media to add a polymethacrylate block at each reactive site of the living polyalkadienyl polymer. Regardless of the type of block copolymer being produced, the relative proportion of the long-chain alkyl methacrylate to be employed will reflect the composition of the desired block copolymer. Typically, sufficient long-chain alkyl methacrylate is provided to constitute from about 10% to about 40% of the molecular weight of the block copolymer. Reaction takes place in the mixed solvent at a temperature of between about 0° C. to about −78° C., preferably from about −30° C. to about −60° C. After the production of the alkyl methacrylate block, the polymerization is terminated by reaction with a protic material, typically an alcohol such as methanol or ethanol. The block copolymer is then recovered by well known procedures such as precipitation or solvent removal.

The resulting block copolymers are of the general types AB or ABA wherein A and B have the previously stated meanings. The polymers typically have a number average molecular weight of from about 15,000 to about 5,000,000, preferably from about 20,000 to about 300,000, as determined by gel permeation chromatography. The block polymers of the present invention have a molecular weight distribution (Mw/Mn) of between 1.0 and 5.0, preferably between 1.0 and 2.0, and more preferably between 1 and 1.5. It is recognized that the polymers may contain the residue of a difunctional initiator, if such were used, and the protecting group monomer. The presence of such moieties will have no significant influence on the properties of the polymer so that the block copolymers are fairly represented as copolymers of long-chain alkyl methacrylate and the conjugated alkadiene. The preferred block copolymers are those wherein the total proportion of alkyl methacrylate is from about 5% to about 80% of the total molecular weight of the polymer, particularly from about 5% to about 50% of the total molecular weight. Within the polyalkadiene block, the percentage of monomeric units produced by 1,4-polymerization should be from about 10% to at least about 99%.

One embodiment of the present invention comprises a block copolymer comprising:

(i) at least one block A, wherein A comprises a block of polymerized alkyl methacrylate monomer(s), and (ii) a block B, wherein B comprises a block of polymerized conjugated alkadienes, with the proviso that from 50 to 100% by weight of the monomers used in forming block A are C12–C30 alkyl methacrylates.

Another embodiment of the present invention is a process for preparing A-B block copolymers, said process comprises the steps of:

i) in a reactor, anionically polymerizing a conjugated diene monomer with an initiator, I, in a non-polar solvent to form a reaction mixture comprising a living polymer of the formula B-I and the non-polar solvent; wherein the initiator, I, comprises R-M in which M is an alkali metal or an alkaline earth metal and R is a straight-chain or branched alkyl or cyclo-alkyl preferably having from 1 to 6 carbon atoms, an aryl or an alkylaryl; wherein B represents the polyalkadiene formed from the polymerization of the diene monomer; and wherein the polymerization is conducted at a temperature of from 20 to 70° C.;

ii) reducing the temperature of the reaction mixture formed in step i) to between −10 and 20° C. and adding to said reaction mixture a protecting group monomer and from 5 to 50% by weight, relative to the non-polar solvent, of a polar solvent;

iii) allowing the reaction mixture formed in step ii) to react for a time sufficient to allow the protecting group monomer to react with the living polymer B-I;

iv) lowering the temperature of the reaction mixture formed in step iii), if necessary, to between 0 and −78° C.; and v) adding alkyl methacrylate monomer(s) to said reaction mixture to form an A-B block copolymer; wherein A represents the polymer obtained by the polymerization of the alkyl methacrylate monomer(s); and wherein from 50 to 100% of the monomers used in forming block A are C12–C30 alkyl methacrylates;

with the proviso that a lithium salt is added to the reactor during any of steps i), ii), iii) or iv).

Another embodiment of the present invention is a process for preparing A-B-A block copolymers, said process comprises the steps of:

i) in a reactor, anionically polymerizing a conjugated diene monomer with an initiator, I, in a non-polar solvent to form a reaction mixture comprising a living polymer of the formula I-B-I and the non-polar solvent; wherein the initiator, I, comprises a difunctional alkali metal alkyl-initiator; wherein B represents the polyalkadiene formed from the polymerization of the diene monomer; and wherein the polymerization is conducted at a temperature of from 20 to 70° C.;

ii) reducing the temperature of the reaction mixture formed in step i) to between −10 and 20° C. and adding to said reaction mixture a protecting group monomer and from 5 to 50% by weight, relative to the non-polar solvent, of a polar solvent;

iii) allowing the reaction mixture formed in step ii) to react for a time sufficient to allow the protecting group monomer to react with the living polymer I-B-I;

iv) lowering the temperature of the reaction mixture formed in step iii), if necessary, to between 0 and −78° C.; and v) adding alkyl methacrylate monomer(s) to said reaction mixture to form an A-B-A block copolymer; wherein A represents the polymer obtained by the polymerization of the alkyl methacrylate monomer(s); and wherein from 50 to 100% of the monomers used in forming block A are C12–C30 alkyl methacrylates;

with the proviso that a lithium salt is added to the reactor during any of steps i), ii), iii) or iv).

For certain applications it may be desired to selectively hydrogenate the copolymers of the present invention. Hydrogenated block copolymers of the invention are produced by selective hydrogenation of the polyalkadiene block of the above base block copolymers without significant hydrogenation of the polymethacrylate block(s). In a particularly preferred embodiment of the present invention, significant hydrogenation, (i.e., greater than about 70% of the unsaturation being hydrogenated) of the diene block is obtained, preferably while maintaining a narrow molecular weight distribution for the block copolymer.

It is known that linear and star-branched poly(isoprenes) are readily and quantitatively hydrogenated using Falk-type catalysts. However, hydrogenation of poly (diene-b-long-chain alkyl methacrylates) has proven difficult due to the presence of the reactive and polar ester groups of the methacrylate block. This problem is compounded further when the diene block is derived from isoprene. Polyisoprene is relatively more difficult to hydrogenate than polybutadiene because adsorption of the molecule onto the catalyst is sterically hindered by the methyl groups of the isoprene unit.

The hydrogenation process suitable for use in the present invention includes solution and bulk catalytic methods selected from the group consisting of tris (triarylphosphinyl) rhodium chloride catalysts (i.e., Wilkinson's Catalyst), diimide hydrogenation and the use of heterogeneous catalysis, e.g., palladium catalysts. The use of heterogeneous catalysis is preferred.

In a particularly preferred embodiment, supported palladium catalysts are used to effect hydrogenation of poly (diene-b-long-chain alkyl methacrylate). Representative supported palladium (Pd) catalysts include Pd on a solid support such as $CaCO_3$ or $BaSO_4$. Typically, the amount of Pd on the solid support is in the range of from 3 to 10%. Hydrogenation may take place in at least one non-polar solvent or a mixed solvent system comprising a non-polar solvent and a minor amount, preferably less than 10%, of a polar solvent.

The block copolymers of the present invention are useful as viscosity index improvers and/or compatibilizers for lubricating oil compositions. The lubricating oil compositions of the present invention comprise a base oil, typically in an amount of from 60 to 99.9% by weight, and the block copolymers of the present invention. The block copolymers will generally be present in the lubricating oil composition in an amount of from 0.1 to 20 percent by weight based on the total weight of the lubricating oil compositions. The base oil suitable for preparing the lubricating oil compositions of the present invention include those oils of lubricating viscosity known in the art such as mineral oils, vegetable oils, synthetic oils and mixtures thereof.

The block copolymers of the present invention can also find use in other applications such as coatings, adhesives, structural plastics and as elastomers.

EXAMPLES

Prior to forming the block copolymers of the present invention, all monomers, solvents and initiators were purified by methods known in the art. All syntheses were carried out using standard vacuum line manipulations and airless techniques. Analogous reactions can also be effected under a blanket of dry nitrogen. A suitable method of preparing the block copolymers of the present invention is set forth below.

LiCl was added to a 1000 mL glass reactor. Moisture was driven off the hygroscopic salt by heating to 120–130° C. under vacuum. sec-Butyllithium was added to the reactor under argon. The amount of initiator used depends on the desired chain length of the polymer product. The more initiator added, for a constant amount of monomer, the shorter the average chain length of the resulting polymer. Approximately 300 mL of purified t-butylbenzene was distilled into the reactor, which was then sealed from the vacuum line. Purified isoprene monomer (8 g) was added to the reactor and allowed to react at 40° C. for four hours. The temperature was reduced to 0° C. and approximately 30 mL of THF was added to the reactor followed by the addition of 1,1-diphenylethylene. A change in color from the pale yellow (almost clear) color indicative of living poly (isoprenyl)lithium to a deep red characteristic of the highly delocalized 1,1-diphenylalkyllithium anion occurred. UV/V is spectroscopy was employed to monitor this crossover reaction.

Once the crossover reaction was complete, the reactor was cooled to −50° C. and 25 mL of a 30% (v/v) solution of lauryl methacrylate in t-butylbenzene was added to the reaction mixture. Polymerization was carried out at −50° C. for 1.5 hours. The reaction was terminated using methanol. The copolymer was isolated by precipitation into excess methanol, washed successively with methanol and vacuum dried.

Representative examples of polymers prepared using the above procedures are set forth in Tables 1 and 2. The monomer and initiator concentrations for forming the block copolymers of Table 1 were selected to prepare block copolymers containing a polyisoprene (PI) segment having a Mn of 100,000 and a polylauryl methacrylate (PLMA) segment having an Mn of 20,000. The monomer and initiator concentrations for forming the block copolymers of Table 2 were selected to prepare block copolymers containing a polyisoprene segment having a Mn of 40,000 and a polylauryl methacrylate segment having an Mn of 40,000. The molecular weight distribution (Mw/Mn) of the PI segment and the block copolymer are given. $^1$H NMR data is provided to show the structure of the polyisoprene segment.

TABLE 1

Characterization of Poly (isoprene-b-lauryl methacrylate) (PI-b-PLMA)

| | Mn | Mw/Mn | $^1$H NMR Data |
|---|---|---|---|
| PI Block | 105,000[a] | 1.02 | 94% 1,4 6% 3,4 |
| PI-b-PLMA | 127,000[b] | 1.06 | |

[a]Mn was determined using poly (isoprene) standards
[b]Mn was determined by the universal calibration method as taught in Freyss, D.; Rempp, P.; Benoit, H. Polym. Lett. 1964, 2, 217.

TABLE 2

Characterization of Poly (isoprene-b-lauryl methacrylate) (PI-b-PLMA)

| | Mn | Mw/Mn | $^1$H NMR Data |
|---|---|---|---|
| PI Block | 47,100[a] | 1.02 | 94% 1,4 6% 3,4 |
| PI-b-PLMA | 89,000[b] | 1.06 | |

[a]Mn determined using poly (isoprene) standards
[b]Mn was determined by the universal calibration method as taught in Freyss, D.; Rempp, P.; Benoit, H. Polym. Lett. 1964, 2, 217.

As can be seen from the above Tables, block copolymers of the present invention exhibit an exceptionally narrow molecular weight distribution as well as polyisoprene segments having a very high 1,4 content.

As discussed above, it may be desirable to hydrogenate the block copolymers of the present invention. Table 3 demonstrates the effectiveness of supported Pd catalysts in the hydrogenation of the block copolymers of the present invention. Table 3 sets forth the reaction conditions, percent conversion and molecular weight distribution (MWD) for poly (isoprene-b-lauryl methacrylate) copolymers of the present invention. The starting copolymers had a number average molecular weight of 92,000 g/mole (50 wt. % polyisoprene) and a molecular weight distribution of 1.09. The catalyst used in all examples was 5% Pd on solid support indicated.

TABLE 3

Hydrogenation of Poly (isoprene-b-lauryl methacrylate)

| | Catalyst | Mol % Catalyst | Solvent (vol. %) | Temp (° C.) | $H_2$ Pressure (psi) | Time (h) | % Conv | MWD |
|---|---|---|---|---|---|---|---|---|
| 1 | $Pd/CaCO_3$ | 9.7 | CHA[a] | 65 | 50 | 60 | 87 | 1.1 |
| 2 | $Pd/CaCO_3$ | 9.8 | Decalin/n-Decane (40/60) | 125 | 80 | 124 | 76 | —[b] |
| 3 | $Pd/CaCO_3$ | 9.8 | CHA | 75 | 500 | 72 | 86 | <1.2 |
| 4 | $Pd/BaSO_4$ | 12.3 | CHA/ Pentanol (95/5) | 59 | 250 | 10.5 | 97 | >4.0 |
| 5 | $Pd/CaCO_3$ | 12.3 | CHA/ Pentanol (95/5) | 56 | 200 | 20 | 95.4 | 4.0 |
| 6 | $Pd/CaCO_3$ | 15.5 | CHA/ THF (95/5) | 100 | 190 | 17 | 100 | >4.0 |
| 7 | $Pd/CaCO_3$ | 10.6 | CHA/ THF (95/5) | 60 | 270 | 24 | 100 | >4.0 |

[a]Cyclohexane
[b]MWD not determined

The data in Table 3 indicates that supported Pd is an effective catalyst for hydrogenation of poly (isoprene-b-lauryl methacrylate). All of the above examples gave significant levels of hydrogenation. The copolymers hydrogenated in a non-polar solvent gave lower levels of hydrogenation but maintained the excellent narrow molecular weight distribution. The copolymers hydrogenated in the mixed solvent gave higher levels of saturation but resulted in increased molecular weight distributions.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

We claim:

1. A block copolymer comprising:

(i) at least one block A, wherein A comprises a block of polymerized alkyl methacrylate monomer(s), and (ii) a block B, wherein B comprises a block of polymerized conjugated alkadienes, with the proviso that from 50 to 100% by weight of the monomers used in forming block A are C12–C30 alkyl methacrylates.

2. The block copolymer of claim 1 wherein the block copolymer has a molecular weight distribution of between 1.0 and 5.0.

3. The block copolymer of claim 1 wherein from 50 to 100% by weight of the monomers used in forming block B are conjugated alkadienes.

4. The block copolymer of claim 1 wherein from 90 to 100% by weight of the monomers used in forming block B are conjugated alkadienes.

5. The block copolymer of claim 1 wherein said conjugated alkadienes comprise at least one monomer selected from the group consisting of butadiene and isoprene.

6. The block copolymer of claim 1 wherein from 80 to 100% by weight of the monomers used in forming block A are C12–C30 alkyl methacrylates.

7. The block copolymer of claim 1 wherein said C12–C30 alkyl methacrylate comprises lauryl methacrylate.

8. The block copolymer of claim 1 wherein from 95 to 100% by weight of the monomer used in forming block A is lauryl methacrylate and wherein from 95 to 100% by weight of the monomer used in forming block B is isoprene.

9. A lubricating oil composition comprising an oil of lubricating viscosity and the block copolymer of claim 1.

10. A composition of matter comprising the block copolymer of claim 1 wherein said composition is selected from the group consisting of coatings, adhesives, structural plastics and elastomers.

11. A hydrogenated block copolymer obtained by hydrogenating the block copolymer of claim 1.

12. The hydrogenated block copolymer of claim 11 wherein the block copolymer is selectively hydrogenated.

13. The hydrogenated block copolymer of claim 12 wherein the block copolymer is hydrogenated by solution or bulk catalytic methods selected from the group consisting of tris (triarylphosphinyl) rhodium chloride catalysts, diimide hydrogenation and heterogeneous catalysis.

14. The hydrogenated block copolymer of claim 13 wherein the block copolymer is hydrogenated using supported palladium catalysts.

15. A process for preparing A-B block copolymers comprising:

(i) in a reactor, anionically polymerizing a conjugated diene monomer with an initiator, I, in a non-polar solvent to form a reaction mixture comprising a living polymer of the formula B-I and the non-polar solvent; wherein the initiator, I, comprises R-M in which M is an alkali metal or an alkaline earth metal and R is a straight-chain or branched alkyl or cyclo-alkyl preferably having from 1 to 6 carbon atoms, an aryl or an alkylaryl; wherein B represents the polyalkadiene formed from the polymerization of the diene monomer; and wherein the polymerization is conducted at a temperature of from 20 to 70° C.;

(ii) reducing the temperature of the reaction mixture formed in step i) to between −10 and 20° C. and adding to said reaction mixture a protecting group monomer and from 5 to 50% by weight, relative to the non-polar solvent, of a polar solvent;

(iii) allowing the reaction mixture formed in step ii) to react for a time sufficient to allow the protecting group monomer to react with the living polymer B-I;

(iv) lowering the temperature of the reaction mixture formed in step iii), if necessary, to between 0 and −78° C.; and (v) adding alkyl methacrylate monomer(s) to said reaction mixture to form an A-B block copolymer; wherein A represents the polymer obtained by the polymerization of the alkyl methacrylate monomer(s); and wherein from 50 to 100% of the monomers used in forming block A are C12–C30 alkyl methacrylates;

with the proviso that a lithium salt is added to the reactor during any of steps i), ii), iii) or iv).

16. The process for preparing A-B block copolymers of claim 15 wherein from 50 to 100% by weight of the monomers used in forming block B are conjugated alkadienes.

17. The process for preparing A-B block copolymers of claim 15 wherein from 90 to 100% by weight of the monomers used in forming block B are conjugated alkadienes.

18. The process for preparing A-B block copolymers of claim 15 wherein said conjugated alkadienes comprise at least one monomer selected from the group consisting of butadiene and isoprene.

19. The process for preparing A-B block copolymers of claim 15 wherein from 80 to 100% by weight of the monomers used in forming block A are C12–C30 alkyl methacrylates.

20. The process for preparing A-B block copolymers of claim 15 wherein said C12–C30 alkyl methacrylate comprises lauryl methacrylate.

21. The process for preparing A-B block copolymers of claim 15 wherein from 95 to 100% by weight of the monomer used in forming block A is lauryl methacrylate and wherein from 95 to 100% by weight of the monomer used in forming block B is isoprene.

22. The process of claim 15 wherein said initiator comprises sec-butyl lithium.

23. The process of claim 15 wherein said lithium salt is selected from at least one member of the group consisting of lithium chloride and lithium alkoxides.

24. The process of claim 23 wherein said lithium salt comprises lithium chloride.

25. An A-B block copolymer obtained by the process of claim 15.

26. A lubricating oil composition comprising an oil of lubricating viscosity and the A-B block copolymer of claim 25.

27. A composition of matter comprising the A-B block copolymer of claim 25 wherein said composition is selected from the group consisting of coatings, adhesives, structural plastics and elastomers.

28. A hydrogenated block copolymer obtained by hydrogenating the A-B block copolymer of claim 25.

29. The hydrogenated block copolymer of claim 28 wherein the A-B block copolymer is selectively hydrogenated.

30. The hydrogenated block copolymer of claim 29 wherein the A-B block copolymer is hydrogenated by solution or bulk catalytic methods selected from the group consisting of tris (triarylphosphinyl) rhodium chloride catalysts, diimide hydrogenation and heterogeneous catalysis.

31. The hydrogenated block copolymer of claim 30 wherein the A-B block copolymer is hydrogenated using supported palladium catalysts.

32. A process for preparing A-B-A block copolymers comprising:

(i) in a reactor, anionically polymerizing a conjugated diene monomer with an initiator, I, in a non-polar solvent to form a reaction mixture comprising a living polymer of the formula I-B-I and the non-polar solvent; wherein the initiator, I, comprises a difunctional alkali metal alkyl-initiator; wherein B represents the polyalkadiene formed from the polymerization of the diene monomer; and wherein the polymerization is conducted at a temperature of from 20 to 70° C.;

(ii) reducing the temperature of the reaction mixture formed in step i) to between −10 and 20° C. and adding to said reaction mixture a protecting group monomer and from 5 to 50% by weight, relative to the non-polar solvent, of a polar solvent;

(iii) allowing the reaction mixture formed in step ii) to react for a time sufficient to allow the protecting group monomer to react with the living polymer I-B-I;

(iv) lowering the temperature of the reaction mixture formed in step iii), if necessary, to between 0 and −78° C.; and (v) adding alkyl methacrylate monomer(s) to said reaction mixture to form an A-B-A block copolymer; wherein A represents the polymer obtained by the polymerization of the alkyl methacrylate monomer(s); and wherein from 50 to 100% of the monomers used in forming block A are C12–C30 alkyl methacrylates;

with the proviso that a lithium salt is added to the reactor during any of steps i), ii), iii) or iv).

33. The process for preparing A-B-A block copolymers of claim 32 wherein from 50 to 100% by weight of the monomers used in forming block B are conjugated alkadienes.

34. The process for preparing A-B-A block copolymers of claim 32 wherein from 90 to 100% by weight of the monomers used in forming block B are conjugated alkadienes.

35. The process for preparing A-B-A block copolymers of claim 32 wherein said conjugated alkadienes comprise at least one monomer selected from the group consisting of butadiene and isoprene.

36. The process for preparing A-B-A block copolymers of claim 32 wherein from 80 to 100% by weight of the monomers used in forming block A are C12–C30 alkyl methacrylates.

37. The process for preparing A-B-A block copolymers of claim 32 wherein said C12–C30 alkyl methacrylate comprises lauryl methacrylate.

38. The process for preparing A-B-A block copolymers of claim 32 wherein from 95 to 100% by weight of the monomer used in forming block A is lauryl methacrylate and wherein from 95 to 100% by weight of the monomer used in forming block B is isoprene.

39. The process of claim 32 wherein said initiator comprises sec-butyl lithium.

40. The process of claim 32 wherein said lithium salt is selected from at least one member of the group consisting of lithium chloride and lithium alkoxides.

41. The process of claim 40 wherein said lithium salt comprises lithium chloride.

42. An A-B-A block copolymer obtained by the process of claim 32.

43. A lubricating oil composition comprising an oil of lubricating viscosity and the A-B-A block copolymer of claim 42.

44. A composition of matter comprising the A-B-A block copolymer of claim 42 wherein said composition is selected from the group consisting of coatings, adhesives, structural plastics and elastomers.

45. A hydrogenated block copolymer obtained by hydrogenating the A-B-A block copolymer of claim 42.

46. The hydrogenated block copolymer of claim 45 wherein the A-B-A block copolymer is selectively hydrogenated.

47. The hydrogenated block copolymer of claim 46 wherein the A-B-A block copolymer is hydrogenated by solution or bulk catalytic methods selected from the group consisting of tris (triarylphosphinyl) rhodium chloride catalysts, diimide hydrogenation and heterogeneous catalysis.

48. The hydrogenated block copolymer of claim 47 wherein the A-B-A block copolymer is hydrogenated using supported palladium catalysts.

* * * * *